US010526840B2

(12) United States Patent
Torrabias Cantal

(10) Patent No.: US 10,526,840 B2
(45) Date of Patent: Jan. 7, 2020

(54) PERIMETRICAL FRAME FOR GLASS DOORS

(71) Applicant: Oscar Torrabias Cantal, Sant Quirze de Besora (ES)

(72) Inventor: Oscar Torrabias Cantal, Sant Quirze de Besora (ES)

( * ) Notice: Subject to any disclaimer, the term of this patent is extended or adjusted under 35 U.S.C. 154(b) by 0 days.

(21) Appl. No.: 16/359,109

(22) Filed: Mar. 20, 2019

(65) Prior Publication Data

US 2019/0292843 A1 Sep. 26, 2019

(51) Int. Cl.

| | |
|---|---|
| ***E06B 7/24*** | (2006.01) |
| ***E06B 3/263*** | (2006.01) |
| ***E06B 3/67*** | (2006.01) |
| ***E06B 3/968*** | (2006.01) |
| ***E06B 3/02*** | (2006.01) |

(52) U.S. Cl.

CPC ..... *E06B 7/24* (2013.01); *E06B 3/26347* (2013.01); *E06B 3/67* (2013.01); *E06B 3/02* (2013.01); *E06B 3/9685* (2013.01)

(58) Field of Classification Search

CPC ..... E06B 1/6046; E06B 3/42; E06B 3/4636; E06B 3/4681; E06B 3/46; E06B 3/26347; E06B 3/487; E06B 3/488; E06B 3/585; E06B 3/60; E06B 2003/26398; E06B 7/24

See application file for complete search history.

(56) References Cited

U.S. PATENT DOCUMENTS

| | | | | |
|---|---|---|---|---|
| 2010/0101150 | A1* | 4/2010 | Huang | E05D 15/063 49/409 |
| 2010/0192469 | A1* | 8/2010 | McDaniel | E06B 1/70 49/469 |
| 2014/0143980 | A1* | 5/2014 | Chang | E05D 15/0639 16/91 |
| 2018/0274285 | A1* | 9/2018 | Haab | E06B 3/4636 |
| 2019/0038086 | A1* | 2/2019 | Wei | A47K 3/362 |

FOREIGN PATENT DOCUMENTS

| | | | | |
|---|---|---|---|---|
| DE | 102007057293 | A1 * | 7/2008 | A47K 3/30 |
| EP | 1916373 | A2 * | 4/2008 | E05D 15/0652 |
| EP | 3020898 | A1 * | 5/2016 | E05D 15/0634 |
| EP | 3029228 | A1 * | 6/2016 | E05B 65/0811 |

* cited by examiner

*Primary Examiner* — Christine T Cajilig

(74) *Attorney, Agent, or Firm* — Defillo & Associates, Inc.; Evelyn A. Defillo

(57) ABSTRACT

Perimeter frame for sliding glass doors of the type including extruded metal profiles that are combined together circumferentially surrounding the glass sheet having two lateral profiles (1) arranged vertically and that fit on the sides of the glass sheet (4), a set of lower profiles (2) arranged horizontally on each side of the glass sheet (4) at its lower part and a set of upper profiles (3) arranged vertically in the upper area of the sheet glass (4), between which there is provided an opening (5) through which protrudes the upper portion of the glass (6), in which the clamps (7) that hold the sheet are applied.

6 Claims, 4 Drawing Sheets

PERIMETRICAL FRAME FOR GLASS DOORS

TECHNICAL FIELD

The invention refers to a frame for installation in sliding glass doors for interiors, consisting of a perimeter structure inside which the door leaf is fixed and whose purpose is to improve the closing capacity, increasing the level of thermal and acoustic insulation of the door. Another functional aspect of these frames is the aesthetic modification of the glass leaf, for example to simulate a panel-type door.

STATE OF THE ART

The sliding glass doors basically consist of a guide through which run a pair of mobile carts to which are attached clamps that hold the glass leaf, which moves sideways to open or close the passage.

These doors are highly valued solutions in interior design projects in which it is necessary to take advantage of the available space, as well as to join and separate spaces at any time.

Compared to these advantages, they have the disadvantage that their closing capacity is lower than that of a hinged type door, so that the acoustic and thermal insulation achieved is clearly lower.

As a solution, the sheets of glass are incorporated into metal frames which improve the thermal and acoustic insulation capabilities of the door, as well as giving them a more sophisticated aesthetic.

In these cases, the clamps of the glass leaf are replaced by brackets that can be attached to the door frame. In this way, the weight of the sheet of glass is supported by the frame and, in particular, by the upper horizontal crossbar of it.

The problem with this technique lies in the fact that, when the glass leaf is large and, therefore, heavy, the upper crossbar is not capable of supporting the weight of the glass, permanently warping and deforming, even leading to the breakage of the glass.

It would therefore be beneficial to develop a perimeter frame for sliding glass doors whose structure would not be compromised by the weight of the glass leaf regardless of its dimensions.

EXPLANATION OF THE INVENTION

The present invention has as object a perimeter frame for sliding glass doors that presents a configuration such that it is not the frame that supports the weight of the glass leaf, but the opposite, the glass leaf supports the weight of the frame, so that this is not subjected to any kind of tension or forces, so that, independently of the dimensions of the sliding door, the stability of the metallic frame is guaranteed.

Specifically, the invention consists of a set of extruded metal profiles that combine with each other around the perimeter of the sheet of glass to form a frame.

This frame adjusts to the sides and lower side of the glass sheet and forms an opening in its upper horizontal section by which a portion of glass protrudes through which it is held by means of a conventional system of clamps coupled to mobile trolleys that can be moved by a guide.

In this way, the glass leaf hangs from the clamps just like a conventional glass sliding door, while the frame is fixed to its sides without receiving any kind of load, since its weight is supported by a set of wheels, located in the lower horizontal section of the frame, which roll on the floor of the room or on a track set up for this purpose.

Since the sheet of glass and the frame are solidary, the displacement of one of them will drag the other, as if it were a monobloc element.

DESCRIPTION OF THE DRAWINGS

In order to illustrate what has been exhibited so far, this descriptive report is accompanied by a set of drawings that are illustrative only and do not limit the practical possibilities of the invention.

In those drawings.

LIST OF REFERENCES

Figure 1:
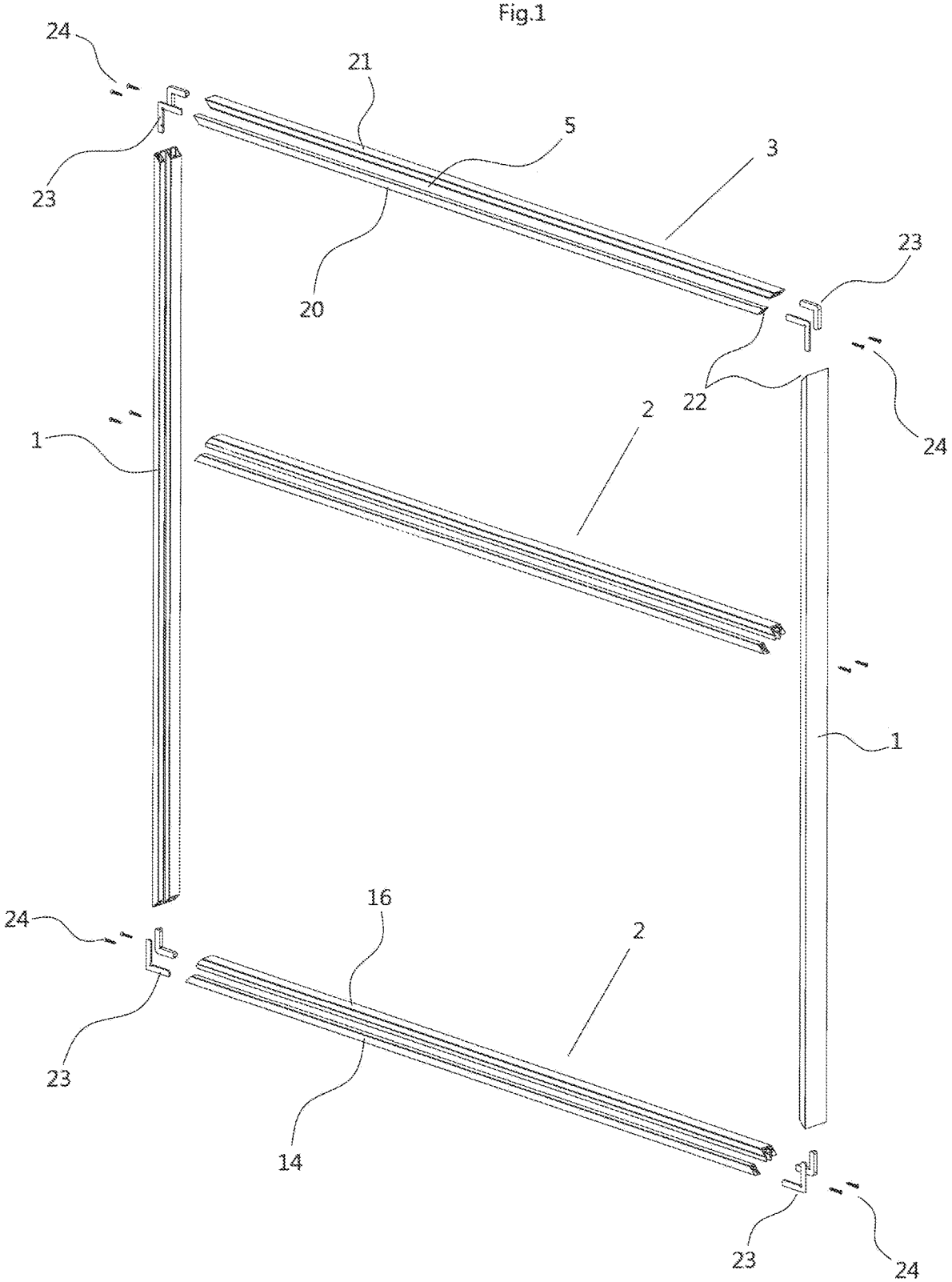
FIG. 1 corresponds to an exploited view of the invention showing all its constituent elements.
Figure 2:
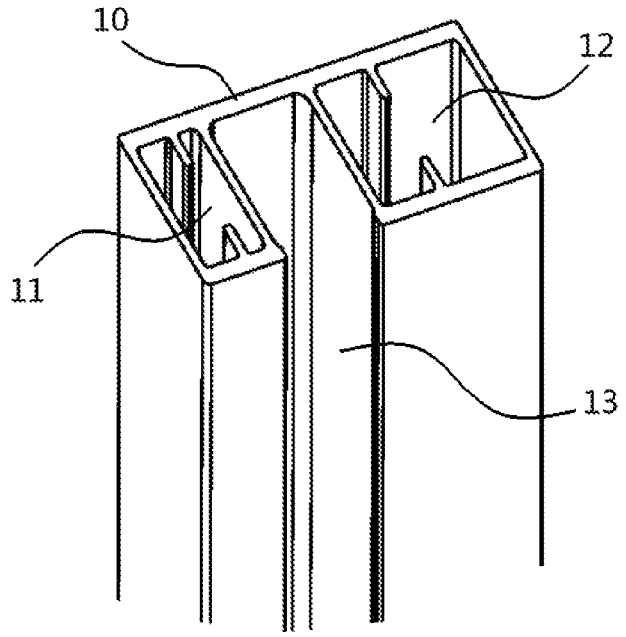
FIG. 2 represents a detailed view of the side profiles that are part of the invention.
Figure 3:
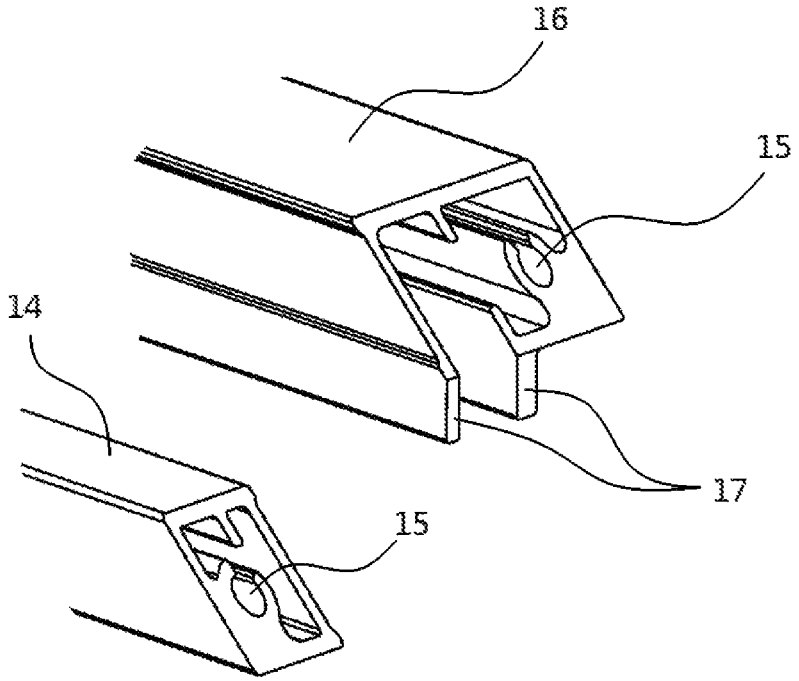
FIG. 3 represents a detailed view of the lower profiles that are part of the invention.
Figure 4:
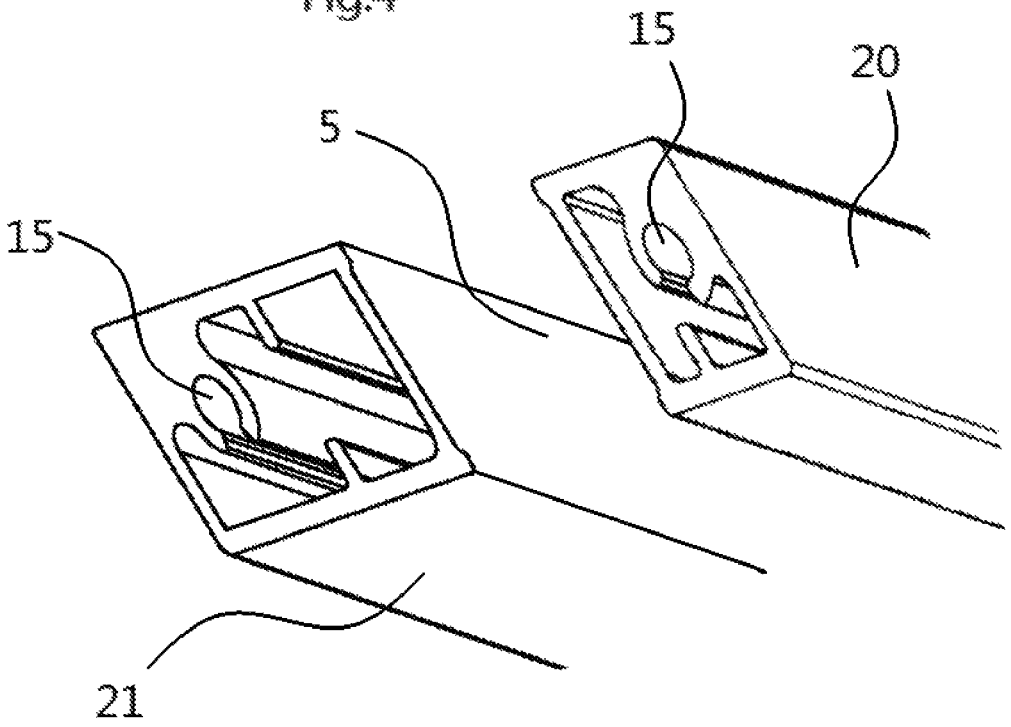
FIG. 4 represents a detailed view of the upper profiles that are part of the invention.
Figure 5:
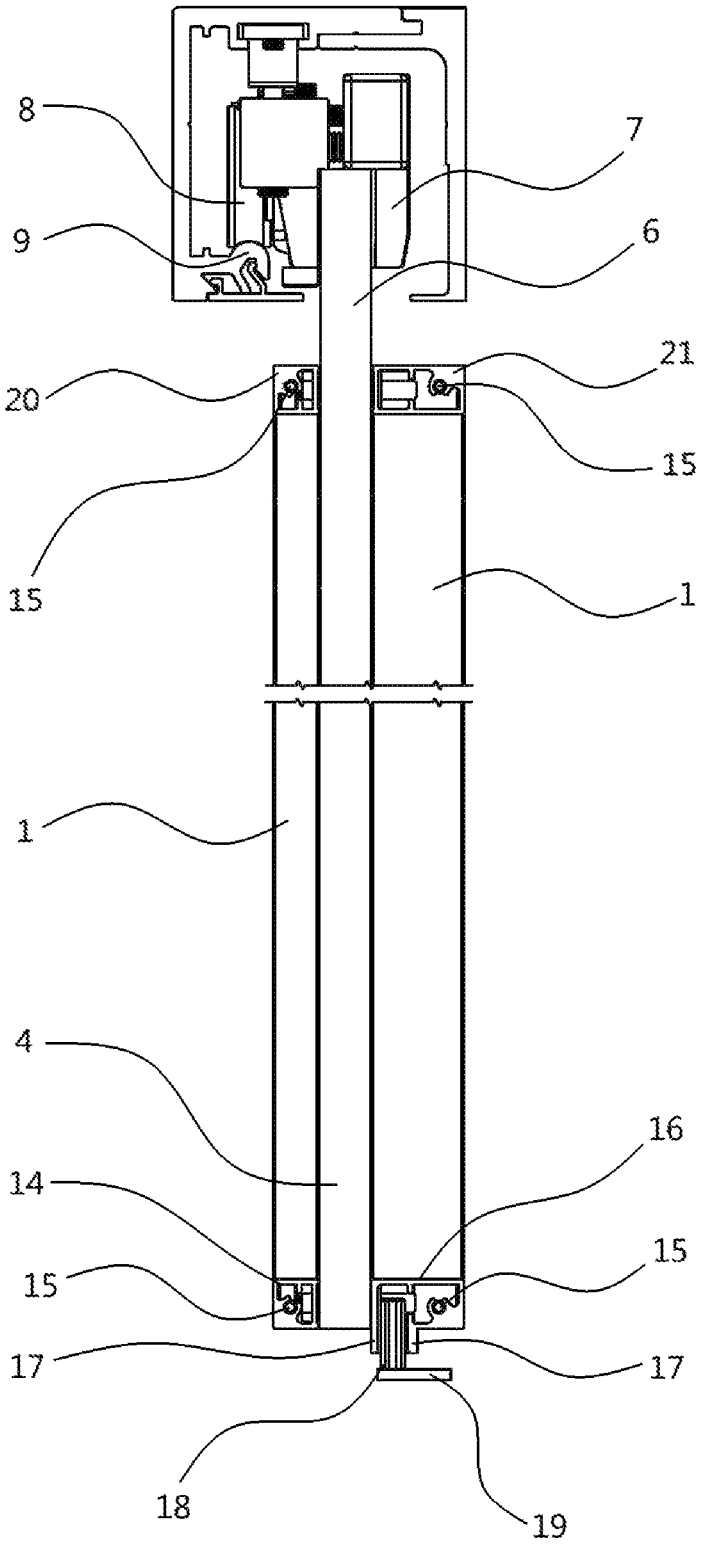
FIG. 5 represents a section view of the new frame built into a sliding door.

1. Side profiles
2. Set of lower profiles
3. Set of upper profiles
4. Crystal Leaf
5. Opening
6. Upper portion of glass
7. Tweezers
8. Pincer wheel
9. Guide
10. Flat wall
11. Minor boxing
12. larger box
13. Seat
14. External bottom profile
15. Circular rib
16. Internal bottom profile
17. Vertical walls
18. Bottom wheel
19. Track
20. External top profile
21. Upper internal profile
22. Miter cutting
23. Squares
24. Screws

DESCRIPTION OF A PRACTICAL EXAMPLE

According to the drawings, the new perimeter frame for sliding glass doors consists of two side profiles (1) arranged vertically and fitting to the sides of the glass leaf (4), a set of lower profiles (2) arranged horizontally on each side of the glass leaf (4) at the bottom and a set of upper profiles (3) arranged vertically in the upper area of the glass leaf (4), between which there is an opening (5) through which the upper portion of the glass (6) protrudes, in which the tweezers (7) holding the leaf are applied, which incorporate a wheel (8) that moves along a guide (9).

The side profiles (1) have a structure with a flat wall (10) delimiting a smooth outer face and an inner face with two boxes, a smaller box (11) and a larger box (12), both separated by a seating area (13) in which the side of the sheet of glass (4) is inserted.

The set of bottom profiles (2) consists of an external bottom profile (14) and an internal bottom profile (16).

The external lower profile (14) has a section corresponding to the smaller groove (11) of the lateral profile (1) and a circular rib (15) is provided within it.

The lower internal profile (16) has a section which essentially corresponds to the larger groove (12) of the lateral profile (1), differing from this by incorporating a longitudinal opening in its lower face, framed by two small vertical walls (17), in which there is a lower wheel (18) which runs on a track (19). The opposite side to the vertical walls (17) has a circular rib (15) in its sinus.

The set of upper profiles (3) consists of an external upper profile (20) and an internal upper profile (21).

The external upper profile (20) has a section corresponding to the smaller groove (11) of the lateral profile (1) and a circular rib (15) is provided within it.

The inner upper profile (21) has a section in accordance with the larger groove (12) of the lateral profile (1) and has a circular rib (15) in its bosom.

All the profiles have their ends cut to miter (22) and they are in solidarity with each other forming a 90° angle by means of brackets (23) which are inserted into the inner hollow of each profile, their position being fixed by means of two screws (24) which are threaded to the circular ribs (15) present inside the set of lower profiles (2) and set of upper profiles (3).

Operationally, a second set of upper profiles (2) placed in a lower area than the first set can be incorporated, so that the sliding door acquires a panel appearance despite being made up of a single sheet of glass.

The invention claimed is:

1. A perimeter frame for sliding glass doors of extruded metal profiles which combine with each other around a perimeter of a glass leaf, the perimeter frame comprising two side profiles (1) arranged vertically and fitted to sides of the glass leaf (4), a set of lower profiles (2) arranged horizontally on each of the sides of the glass leaf (4) at a bottom; and a first set of upper profiles (3) arranged horizontally in an upper part of the glass leaf (4), between which there is an opening (5) through which the upper part of the glass (6) protrudes, in which clamps (7) holding the sheet are applied.

2. The perimeter frame for sliding glass doors according to claim 1, wherein the lateral profiles (1) present a structure in which a flat wall is observed (10) that delimits a smooth exterior face and an interior face with a smaller groove (11) and a larger groove (12), both separated by a seat area (13) in which the side of the glass leaf (4) is inserted.

3. The perimeter frame for sliding glass doors according to claim 2, the set of lower profiles (2) is formed by an external lower profile (14) and an internal lower profile (16), wherein:

the external lower profile (14) has a section corresponding to the smaller groove (11) of the lateral profile (1) and including a circular rib (15) is provided; and the internal lower profile (16) has a section which corresponds to the larger groove (12) of the lateral profile (1), and incorporates a longitudinal opening in a lower face, framed by two small vertical walls (17), in which there is a lower wheel (18) which runs on a track (19), wherein an opposite side to the walls (17) has a circular rib (17).

4. The perimeter frame for sliding glass doors according to claim 2, wherein the first set of upper profiles (3) is formed by an external upper profile (20) and an internal upper profile (21), wherein:

the external upper profile (20) has a section corresponding to the smaller groove (11) of the lateral profile (1) and includes a circular rib (15); and the internal upper profile (21) has a section in accordance with the larger groove (12) of the lateral profile (1) and has a circular rib (15).

5. The perimeter frame for sliding glass doors according to claim 3 wherein the profiles have ends cut at a miter (22) and are in solidarity with each other forming a 90° angle by brackets (23) that are inserted into an inner hole of each profile, fixing their position by two screws (24) that are threaded into the circular ribs (15) present inside the set of lower profiles (2) and the first set of upper profiles (3).

6. The perimeter frame for sliding glass doors according to claim 1, further including a second set of upper profiles (2) with ends cut at right angles, placed in a lower area than the first set, fixed only by screws (24) to simulate a panel door.

* * * * *